United States Patent [19]

Hattori et al.

[11] Patent Number: 4,509,906

[45] Date of Patent: Apr. 9, 1985

[54] VANE TYPE ROTARY COMPRESSOR HAVING A WEAR RESISTANT RESIN COATING

[75] Inventors: Toshihiko Hattori; Yuji Akagi; Hideo Kohara, all of Hiroshima, Japan

[73] Assignee: Toyo Kogo Co., Ltd., Hiroshima, Japan

[21] Appl. No.: 595,495

[22] Filed: Mar. 30, 1984

[30] Foreign Application Priority Data

Mar. 31, 1983 [JP] Japan ..... 58-56509

[51] Int. Cl.[3] ..... F04C 29/00

[52] U.S. Cl. ..... 418/152; 418/173; 523/435; 523/458; 523/468; 524/404; 524/406; 524/441

[58] Field of Search ..... 418/173, 178, 179, 152; 523/457, 458, 468, 435; 524/404, 406, 441

[56] References Cited

U.S. PATENT DOCUMENTS

| | | | |
|---|---|---|---|
| 3,234,128 | 2/1966 | McLeish et al. | 524/441 X |
| 3,289,649 | 12/1966 | Lamm | 418/152 X |
| 3,847,518 | 11/1974 | Prasse et al. | 418/152 X |
| 3,904,405 | 9/1975 | Russell et al. | 418/152 X |
| 4,093,578 | 6/1978 | Vasiliev et al. | 523/435 X |
| 4,247,263 | 1/1981 | Pech et al. | 418/152 X |
| 4,465,799 | 8/1984 | Platkiewicz | 523/468 X |

FOREIGN PATENT DOCUMENTS

| | | | |
|---|---|---|---|
| 2421906 | 11/1975 | Fed. Rep. of Germany | 418/152 |
| 78301 | 12/1970 | German Democratic Rep. | 418/152 |
| 40657 | 12/1970 | Japan | 523/458 |
| 126512 | 11/1978 | Japan | 418/152 |
| 3375 | 1/1980 | Japan | 524/404 |
| 989002 | 4/1965 | United Kingdom | 523/435 |

*Primary Examiner*—Leonard E. Smith

*Attorney, Agent, or Firm*—Fleit, Jacobson, Cohn & Price

[57] ABSTRACT

A rotary compressor comprises a housing having a cylindrical inner wall surface, a rotatable sleeve having an inner and outer surfaces and disposed in the housing for rotation about a first longitudinal axis, a rotor disposed in the sleeve for rotation about a second longitudinal axis which is offset from the first longitudinal axis, a plurality of vanes carried by the rotor to extend substantially in radial directions and having radially outer edges maintained in contact with the inner surface of the sleeve so that the sleeve is rotated as the rotor and the vanes rotate. One or each of the inner wall surface of the housing and the outer surface of the sleeve has a coating comprised of a wear-resistant resin dispersed with 10 to 120 volume part of a solid lubricant and 5 to 50 volume part of metal flakes for 100 volume part of the resin.

5 Claims, 3 Drawing Figures

VANE TYPE ROTARY COMPRESSOR HAVING A WEAR RESISTANT RESIN COATING

Figure 1:
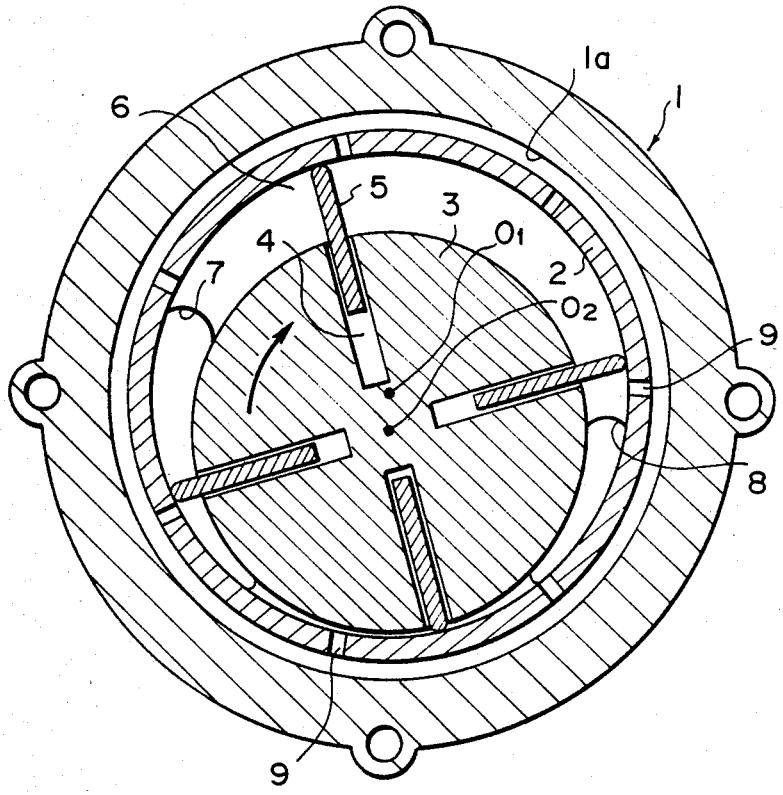

The present invention relates to a displacement type rotary compressor and, more particularly, to a vane type rotary compressor having a plurality of vanes carried by a rotor eccentrically disposed in a housing. More specifically, the present invention pertains to a vane type rotary compressor in which a cylindrical sleeve is rotatably disposed in the housing and the vanes carried by the rotor are adapted to contact with the inner surface of the sleeve.

In conventional vane type compressors wherein vanes carried by an eccentric rotor are maintained in sliding contact with the inner surface of a housing, there have been problems of wears in the vane edges and the housing inner surface as well as seizures of the vane edges. Efforts have therefore been made to eliminate or decrease the problems by improving the materials and the treatments of the sliding surfaces but no satisfactory results have been obtained.

Proposals have also been made in a vane type compressor to provide a structure by which slidable movements of the vane edges are significantly decreased. For example, Japanese utility model publication No. 26-13667 discloses a vane type rotary compressor which includes a stationary housing having a cylindrical inner wall surface, a cylindrical sleeve rotatably disposed in the housing, and a rotor eccentrically disposed in the sleeve and carrying a plurality of vanes so that the outer edges of the vanes are maintained in contact with the inner surface of the sleeve. Japanese patent publication No. 49-23322 proposes an improvement in this type of compressor. By the proposal, the rotatable sleeve is provided at the opposite axial ends with end plates to define a rotatable housing in the stationary housing so as to eliminate problems derived from slidable movements between the vane axial ends and the housing end walls.

These compressors are considered advantageous in that the sliding movements at the vane outer edges can significantly be decreased, however there are further problems of sliding movements between the rotatable sleeve and the housing inner wall. When the compressor is made from an iron based material or an aluminum alloy, there will be produced serious problems of seizure between the sleeve and the housing. It has of course been known for example by a Japanese publication entitled "Displacement Type Compressors" published in June 1970 by the Sangyo Tosho K.K. to lubricate the sliding surfaces by supplying lubricant to the gap between the sleeve and the housing. However, such lubricant produces a drag against the rotation of the sleeve causing a power loss. Further, in case were a leakage of lubricant occur, the lubricant may be mixed with the output air so that this type of lubrication cannot be adopted in a compressor for engine supercharging systems.

It is therefore an object of the present invention to provide a vane type compressor including a rotatable sleeve but being substantially free from the problems derived from the sliding movements between the rotatable sleeve and the housing.

Another object of the present invention is to provide a vane type compressor having a rotatable sleeve, in which problems of wear and seizure between the sleeve and the housing can substantially be eliminated.

According to the present invention, the above and other objects can be accomplished by a rotary compressor comprising a housing having a cylindrical inner wall surface, a rotatable sleeve having an inner and outer surfaces and disposed in the housing for rotation about a first longitudinal axis, a rotor disposed in said sleeve for rotation about a second longitudinal axis which is offset from the first longitudinal axis, a plurality of vanes carried by said rotor to extend substantially in radial directions and having radially outer edges manitained in contact with the inner surface of the sleeve so that the sleeve is rotated as the rotor and the vanes rotate, at least one of the inner wall surface of the housing and the outer surface of the sleeve having a coating comprised of a wear-resistant resin dispersed with 10 to 120 volume part of a solid lubricant and 5 to 50 volume part of metal flakes for 100 volume part of the resin. The wear-resistant resin may for example epoxy resin or polyimide resin. For the solid lubricant, use may be made of molybdenum disulfide, boron nitride, carbon based lubricant such as graphite and powders of fluoric resin. The metal flakes are added for improving the heat resistant property and the anti-peel-off property of the coating and aluminum may be used for the purpose.

According to the features of the present invention, the coating on one or both of the inner wall surface of the housing and the outer surface of the sleeve serves to decrease to a substantial extent the friction between the housing and the sleeve and consequently decrease the wear of the sliding surfaces without supplying lubricant oil. The metal flakes added to the coating provide improved heat resistant property and anti-peel-off property. With the metal flakes content less than 5 volume part, there will be an increase in wear due to poor heat resistant and anti-peel-off properties. However, where the metal flakes content is over 50 volume part, the friction at the sliding surfaces will be unacceptably increased and the wear of the sliding surfaces will also be increased. The solid lubricant content less than 10 volume part causes an insufficient lubrication so that there will be an increase in the driving torque and the wear of the coating. With the solid lubricant content greater than 120 volume part, the resin will not be able to bind the solid lubricant particle sufficiently and the lubricant particles may partially fall off the coating possibly causing an insufficient lubrication.

Figure 2:
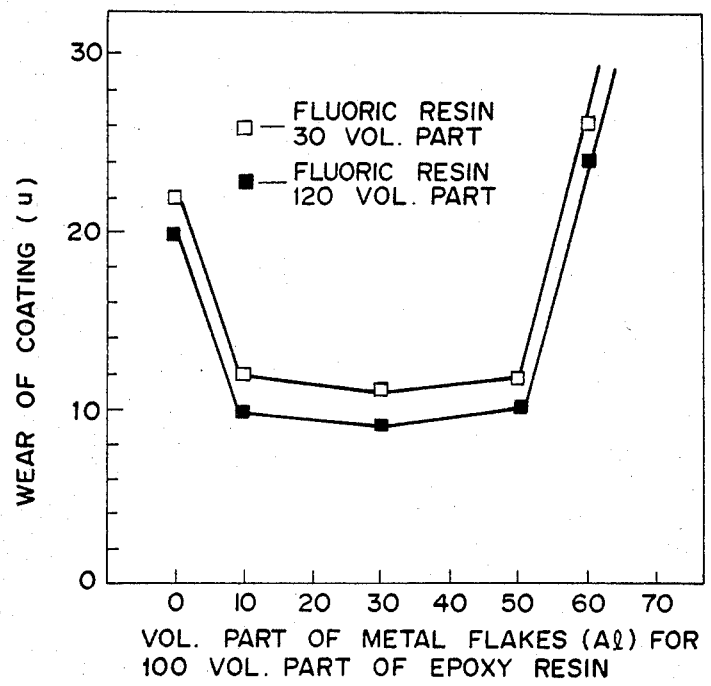
Figure 3:
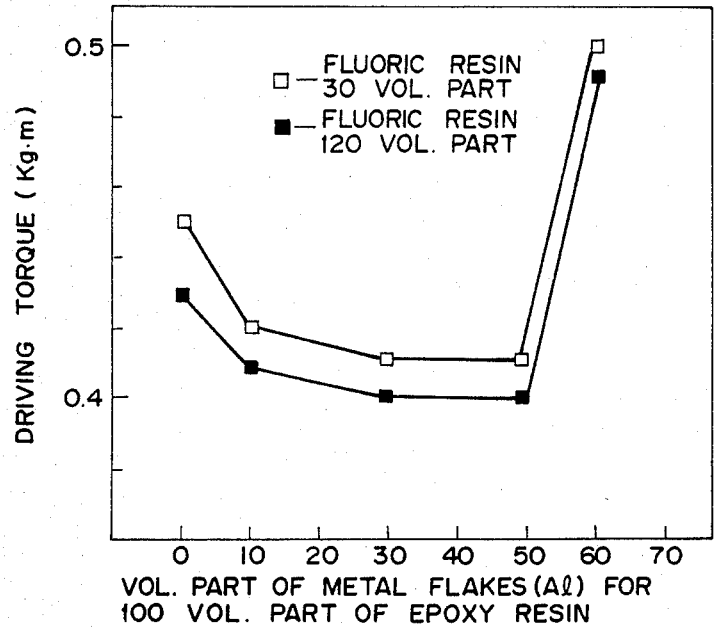

The above and other objects and feature of the present invention will become apparent from the following descriptions of a preferred embodiment taking reference to the accompanying drawings, in which:

FIG. 1 is a sectional view of a vane type rotary compressor to which the present invention can be applied; and, FIGS. 2 and 3 are diagrams showing the effects of the metal flakes added to the coating.

Referring to the drawings, particularly to FIG. 1, there is shown a compressor which includes a housing 1 having a cylindrical inner wall surface 1*a*. In the housing 1, there is rotatably disposed a cylindrical sleeve 2 which has a longitudinal axis $O_1$ about which the sleeve 2 rotates. A rotor 3 is disposed in the sleeve 2 for rotation about a logitudinal axis $O_2$ which is offset from the axis $O_1$. The rotor 3 has four radially directed grooves 4 in which vanes 5 are slidably received. Although not shown in the drawing, the rotor 3 has a driving shaft which is connected with an appropriate power source so that it is driven in the direction shown by an arrow in FIG. 1. The vanes 5 are rotated together with the rotor 3 and forced into contact with the inner surface of the sleeve 2 under a centrifugal force.

At each axial end of the housing 1, there is attached an end plate 6 and one or each end plate 6 is formed with an inlet port 7 and an outlet port 8. The sleeve 2 is formed with a plurality of circumferentially spaced apertures 9 so that compressed air is introduced through the apertures 9 to a space between the housing 1 and the sleeve 2 to provide a pneumatic bearing. In FIG. 1, the gap between the housing 1 and the sleeve 2 is exaggerated but the gap is in actual practice approximately 30 to 50 microns. As described previously, the vanes 5 rotate as the rotor 3 rotates and the vanes 5 are centrifugally forced into contact with the inner surface of the sleeve 2. Therefore, the sleeve 2 is rotated under the frictional force produced between the sleeve 2 and the radially outer edges of the vanes 5. Since the pneumatic bearing is formed between the housing 1 and the sleeve 2, there is produced little drag against the rotation of the sleeve 2 so that the sleeve 2 rotates at a speed substantially corresponding to the rotating speed of the vanes 5.

It should be noted, however, that the pneumatic bearing thus provided is not effective to prevent the sleeve 2 completely from contacting with the housing 1. This is because the pressure of the compressed air functions to force the sleeve sidewardly and the value of the centrifugal force on the vane 5 cyclically changes in each rotation of the vane. Therefore, one or each of the inner wall surface 1*a* of the housing 1 and the outer surface of the sleeve 2 is provided with a coating which is comprised of a wear resistant resin such as epoxy resin or polyimide resin dispersed with 10 to 120 volume part of solid lubricant particles and 5 to 50 volume part of metal flakes for 100 volume part of the resin. The coating is prepared by applying the mixture of the resin and the above additives and heating it to cure the resin. The solid lubricant particles may preferably be of such size between 25 and 30 microns in case of molybdenum disulfide, les than 2 microns in case of boron nitride, less than 30 microns in case of graphite and less than 50 microns in case of fluoric resin.

EXAMPLES

Compressors having structures shown in FIG. 1 1 were prepared by providing the housings and the sleeves with an aluminum alloy meeting AC4C in accordance with Japanese Industrial Standard JIS H-5202. Two types of such compressors were prepared, one being those having coatings of 120 microns thick on the inner wall surfaces of the housings and the other being those having coatings of 120 microns thick on the outer surface of the sleeve. The compressors were operated at 5000 rpm for 5 hours. FIGS. 2 and 3 respectively show the wear and the driving torque obtained in the tests of the compressors having coatings on the sleeve. It will be understood that the metal flakes content in accordance with the present invention provides significant improvements. Similar results could be obtained in those compressors having coatings on the inner wall surfaces of the housings.

Further tests were also made in compressors including housings made of an aluminum alloy (AC4C) and sleeves of cast iron alloy (FCH2C) by operating the compressors at 5000 rpm for 1 hour. The results of the tests are shown in Tables 1 and 2.

TABLE 1

| Coatings on the Sleeve | | | | | |
|---|---|---|---|---|---|
| Resin (volume part) | Metal Flakes (volume part) | Solid Lubricant | Lubricant (volume part) | Driving Torque (kg · m) | Wear of Coating (μ) |
| Epoxy Resin 100 | 15 | graphite | 30 | 0.42 | 12.0 |
| | | fluoric resin | 30 | 0.41 | 11.0 |
| | | boron nitride | 30 | 0.39 | 10.0 |
| 100 | 30 | graphite | 50 | 0.41 | 11.0 |
| | | fluoric resin | 50 | 0.40 | 10.0 |
| | | boron nitride | 50 | 0.39 | 9.5 |
| 100 | 45 | graphite | 80 | 0.41 | 10.5 |
| | | flouric resin | 80 | 0.40 | 10.0 |
| | | boron nitride | 80 | 0.39 | 9.5 |

| FCH2C contains the followings: | | | | | | | | | | |
|---|---|---|---|---|---|---|---|---|---|---|
| C | Si | Mn | P | S | Cr | Cu | Mo | Ni | Others | Fe |
| 3.2–3.7 | 1.7–2.3 | 0.5–0.9 | ≦0.10 | ≦0.10 | 0.10–0.30 | 0.70–1.00 | — | — | Sn0.02–0.05 | balance |

TABLE 2

| Coatings on the Housings | | | | | |
|---|---|---|---|---|---|
| Resin (volume part) | Metal Flakes (volume part) | Solid Lubricant | Lubricant (volume part) | Driving Torque (kg · m) | Wear of Coating (μ) |
| Epoxy Resin 100 | 15 | graphite | 30 | 0.43 | 13.0 |
| | | fluoric resin | 50 | 0.40 | 12.5 |
| | | boron nitride | 80 | 0.40 | 11.0 |
| 100 | 30 | graphite | 30 | 0.42 | 10.5 |
| | | fluoric resin | 50 | 0.39 | 10.0 |
| | | boron nitride | 80 | 0.40 | 9.0 |

We claim:

1. A rotary compressor comprising a housing having a cylindrical inner wall surface, a rotatable sleeve having an inner and outer surfaces and disposed in the housing for rotation about a first longitudinal axis, a rotor disposed in said sleeve for rotation about a second longitudinal axis which is offset from the first longitudinal axis, a plurality of vanes carried by said rotor to extend substantially in radial directions and having radially outer edges maintained in contact with the inner surface of the sleeve so that the sleeve is rotated as the rotor and the vanes rotate, at least one of the inner wall surface of the housing and the outer surface of the sleeve having a coating comprised of a wear-resistant resin dispersed with 10 to 120 volume part of a solid lubricant and 5 to 50 volume part of metal flakes for 100 volume part of the resin.

2. A rotary compressor in accordance with claim 1 in which said resin is selected from epoxy resin and polyimide resin.

3. A rotary compressor in accordance with claim 1 in which said solid lubricant is selected from molybdenum disulfide, boron nitride, carbon based lubricant such as graphite and powders of fluoric resin.

4. A rotary compressor in accordance with claim 1 in which said metal flakes are aluminum.

5. A rotary compressor in accordance with claim 1 in which means is provided for introducing compressed air into a gap between the sleeve and the housing to define a pneumatic bearing.

* * * * *